United States Patent [19]

Kobayashi et al.

[11] Patent Number: 5,005,885

[45] Date of Patent: Apr. 9, 1991

[54] APPARATUS FOR OPERATING LINKAGE OR CAR DOOR BY PIVOTAL LEVER

[75] Inventors: Yasutomo Kobayashi, Chigasaki; Tsuyoshi Kato, Yokohama, both of Japan

[73] Assignee: Nifco, Inc., Yokohama, Japan

[21] Appl. No.: 408,585

[22] Filed: Sep. 18, 1989

[30] Foreign Application Priority Data

Sep. 19, 1988 [JP] Japan ..... 63-121574

[51] Int. Cl.[5] ..... E05B 3/00

[52] U.S. Cl. ..... 292/336.3; 292/DIG. 31

[58] Field of Search ..... 292/336.3, 167, 223, 292/DIG. 31

[56] References Cited

U.S. PATENT DOCUMENTS 3,743,336 7/1973 Andrews ..... 292/173

4,038,718 8/1977 Reilhac ..... 292/DIG. 31

4,778,207 10/1988 Gergoe ..... 292/336.3

FOREIGN PATENT DOCUMENTS 102667 6/1982 Japan .

*Primary Examiner*—Robert L. Wolfe

*Attorney, Agent, or Firm*—Schwartz & Weinrieb

[57] ABSTRACT

An apparatus for opening a car door includes an unlocking linkage and a locking linkage. The unlocking linkage for releasing the door lock is coupled directly to a crank arm of a lever handle movable about a pivot. The locking linkage for locking the door lock is connected by means of a piston-cylinder assembly to the crank arm. The door lock is locked in a first position of the lever handle, released in a second position of the lever handle, and the released door is opened when the lever handle is moved to a third position.

10 Claims, 7 Drawing Sheets

APPARATUS FOR OPERATING LINKAGE OR CAR DOOR BY PIVOTAL LEVER

FIELD OF THE INVENTION

This invention relates generally to an apparatus for operating a linkage by means of a pivotal lever, wherein a crank arm is provided within a lever handle mechanism pivotable about a pivot point so as to operate a car door lock or alternatively is coupled to one end of a linkage for actuating one end of the linkage which, in turn, actuates various mechanisms, and more particularly, to an apparatus for opening a car door by means of a pivotal lever, in which a frame which includes a pivoted lever handle having a crank arm disposed therein is secured to the surface of a car door so as to face or be disposed internally within the car passenger compartment, and wherein a door unlocking linkage is coupled to the frame.

DESCRIPTION OF THE PRIOR ART

Apparatus for operating a linkage by means of a pivotal lever is used within various systems, such as, for example, those for opening and closing a lock of a car door, an oil feeder cover, trunk, or the like, or for operating various mechanisms.

An apparatus for opening a car door by means of a pivotal lever pivoted to a box-like frame is well known in the art as disclosed within Japanese Utility Model Public Disclosure No. 57-102667.

In the prior art apparatus for operating a linkage by means of a pivotal lever, a lever handle is pulled against a biasing force so as to move the linkage in one direction and thereby release an engaged door latch when the door lock is disposed in an unlocked state, thus permitting a car door to open. Furthermore, by releasing the pulled lever handle the linkage is moved in the opposite direction by means of the biasing force so as to engaged the door latch again with the door lock still in an unlocked state. In other words, the lever handle is biased either toward a forward position or toward a return position, and it can only reciprocate between the forward and return positions.

In addition, when the lever handle is disposed at the return position and is accommodated within the box-like frame upon the inner door surface facing the passenger compartment and is pulled toward the forward position in accordance with the prior art apparatus, it was impossible to hold the lever handle at a position projecting slightly outwardly from the frame toward the forward position so as to facilitate the pulling operation for actuating the lever handle.

Furthermore, in accordance with the conventional apparatus for opening a car door by means of a pivotal lever, when the lever handle disposed at the return position and accommodated within the box-like frame provided within the door upon the side facing the car passenger compartment is pulled against the biasing force toward the forward position, the door latch is released when the door lock is disposed in an unlocked state so that the door can be opened or closed. In order to manually lock the door lock so as to prevent opening and closing of the door, however, a separate lock unit has to be operated. For instance, a separate lock button provided upon the inner door surface facing the passenger compartment has to be operated. To this end, it is necessary to provide a lock mechanism for locking and unlocking the door lock such as, for example, a push button in addition to a mechanism for engaging and releasing the door latch such as, for example, a lever handle, and the assembly of such interrelated component parts is very time-consuming.

OBJECTS OF THE INVENTION

Accordingly, the first object of the invention is to provide an apparatus or system for operating a linkage by means of a pivotal lever, in which a lever handle can assume three positions, that is, a forward position, a return position and a neutral position and can be freely moved from the neutral position to the forward and return positions so as to operate the linkage, thus permitting the car door state to achieve anyone of the door-locked, lock-released and door-opening states.

A second object of the invention is to provide an apparatus or system for opening a car door, in which the lever handle can be locked at an accommodated position so that it will not be obstructive and wherein further; it can be brought to a position permitting ready operating thereof when desired.

A third object of the present invention is to provide an apparatus or system for opening a car door, and which also permits releasing and locking the door lock.

SUMMARY OF THE INVENTION

In order to attain the first object of the invention, there is provided an apparatus or system for operating a linkage by means of a pivotal lever, having a crank arm provided upon a lever handle pivoted at a pivot point and coupled to one end of the linkage, comprising: a piston-cylinder assembly including a cylinder having a rod end and a head end, a piston having a piston rod coupled to the crank arm and being accommodated within the cylinder, and a coil spring interposed between the piston and the rod end of the cylinder; a support for supporting the lever handle and the piston cylinder assembly; stopper means extending into the cylinder for receiving an inner side of the head end of the cylinder, and permitting movement of the cylinder toward the head end but preventing movement of the cylinder toward the rod end; a contact portion provided upon the piston rod for abutting an outer side of the rod end of the cylinder when the piston rod is fully projected into the cylinder; and spring bearing means, for engaging one end of the coil spring directed toward the head end of the cylinder, located at an axial position which is the same as that of the piston head when the piston rod is fully projected into the cylinder.

In order to attain the second object of the invention, there is provided an apparatus or system for opening a door of a car by means of a pivotal lever which has a crank arm provided upon a lever handle pivotally mounted within the door and upon the inside of the passenger compartment and which also has an unlocking linkage coupled to the crank arm for releasing the door lock, comprising: a locking linkage coupled to the crank arm for locking the door lock, an outer surface of the lever handle becoming flush with the inside surface of the door upon the inside of the passenger compartment when the door lock is locked by operating the locking linkage by means of the lever handle.

In order to attain the third object of the present invention, there is provided an apparatus or system for opening a car door having a box-like frame which is fixed to a surface of the car door upon the inside of the passenger compartment and upon which a lever handle having a crank arm is pivotally mounted with the pivotal lever having an unlocking linkage coupled to the crank arm for releasing the door lock, comprising: a piston-cylinder assembly including a cylinder having a rod end and a head end, a piston having a piston rod coupled to the crank arm and being accommodated within the cylinder, and a coil spring interposed between the piston and the rod end of the cylinder; a support coupled to the box-like frame for supporting the piston-cylinder assembly; stopper means extending into the cylinder for receiving an inner side of the head end of the cylinder, permitting movement of the cylinder toward the head end of the piston but preventing movement of the cylinder toward the rod end of the piston; a contact portion provided upon the piston rod for abutting an outer surface of the rod end of the cylinder when the piston rod is fully projected into the cylinder; spring bearing means for receiving one end of the coil spring directed toward the head end of the cylinder, located at an axial position which is the same position as that of the piston head when the piston rod is fully projected into the cylinder; a locking linkage coupled to the head end of the cylinder for locking the door lock; a projection integrally formed upon the crank arm; and a cam lever pivotally mounted upon the support and biased so as to be in frictional contact with the projection, the cam lever having a heart cam groove engaged by means of the projection when the lever handle is operated so as to be accommodated within the box-like frame, the heart cam groove serving to lock the lever handle at a state of being accommodated within the box-like frame.

With the aforenoted construction, when the lever handle is maintained at the neutral position slightly outwardly of the box-like frame and is pivoted against the biasing force of the piston-cylinder and spring assembly to a position slightly outwardly of the neutral position, the lock permitting the opening and closing of the door is released by means of the unlocking linkage. Conversely, when the lever handle is pushed against the biasing force from its neutral position into the box-like frame, the lock having permitted the opening and closing of the door is locked so as to prevent the opening and closing of the door. At the same time, the lever handle is locked as a result of the projection being maintained within the heart-shaped cam groove against the biasing force at a position accommodated within the box-like frame. When the lever handle thus locked is pushed still further, the lock is released, and the lever handle is biased and returned to the neutral position out of the box-like frame, thus releasing the door lock to a state wherein the door lock.

BRIEF DESCRIPTION OF THE DRAWINGS

The above and other objects and features of the invention will become more apparent from the following detailed description with reference to the accompanying drawings, in which like reference characters designate like or corresponding parts throughout the several views, and wherein.

DETAILED DESCRIPTION OF THE PREFERRED EMBODIMENT

Figure 1:
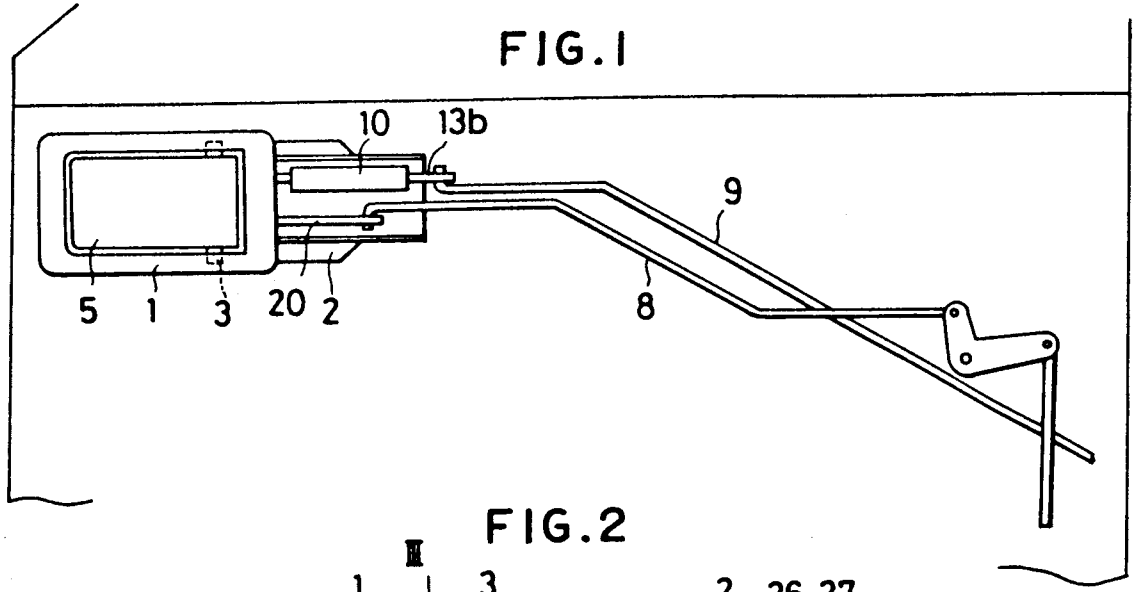
FIG. 1 is a schematic front view showing one embodiment of the apparatus for opening a car door according to the invention.

In accordance with the illustrated embodiment of the present invention, reference numerals 1 and 2 designate supports. More particularly, support 1 is a box-like frame having a well-known structure, which is fitted within an opening of and secured upon an inner panel 6 of a car. A lever handle 5 having a crank arm 4 is pivotally coupled to the frame 1 by means of a pivot pin 3. The support 2 is a base interposed between and secured to the outer surface of the frame 1 and an door inner metal panel 7 of the door. The door is provided with a door latch for latching the door in a closed position relative to the doorway of the car. Within the door, there is provided an unlocking linkage 8 for releasing a door lock through means of the lever handle 5 within the car so as to bring the door latch to a state whereby the same can be operated from both the inside and outside of the car so as to permit the door to be opened and closed, and a locking linkage 9 for locking the door lock when the same is in the released state so as to lock the door so that it can be neither opened nor closed.

Figure 5:
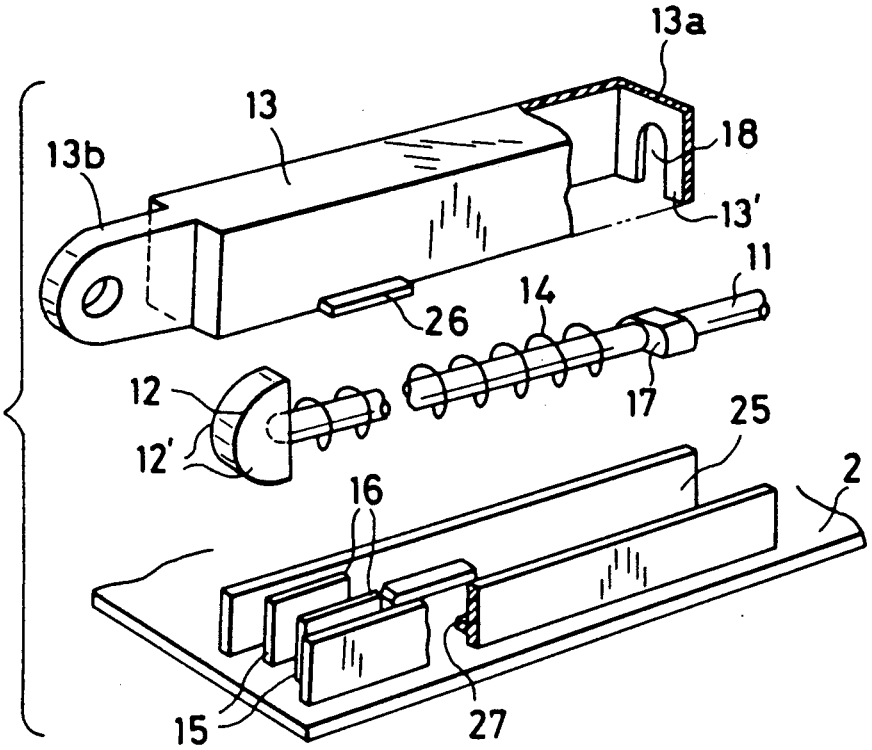
FIG. 5 is an exploded perspective view showing a base and a piston-cylinder assembly of the apparatus shown in FIG. 1.

The piston-cylinder assembly 10 is mounted upon the support 2 such that the axial extent thereof is disposed in a direction perpendicular to the axis of pivot 3. A piston rod 11 of the piston-cylinder assembly 10 is coupled to the crank arm 4 of the lever handle 5. A coil spring 14 is mounted within a cylinder 13 of assembly 10 such that it is disposed about the piston rod 11 and compressed between a piston 12 and a rod end **13*a* of the cylinder 13. In accordance with this embodiment, the cylinder 13 is in the form of an elongate box having an open surface, as best seen in FIG. 5, which is closed by means of the base 2. The piston 12 is substantially flat and has a thickness substantially equal to the diameter of the rod 11 (FIG. 5). Thus, the end of the coil spring 14 directed toward a head end 13*b* of the cylinder 13 extends radially outwardly beyond the opposite flat surfaces 12' of the piston 12**.

The base 2 is provided with stoppers 15 which extend into the cylinder 13, as best seen in FIG. 5, which is the head end 13b of the cylinder 13 and thereby permit movement of the cylinder 13 toward the head end 13b but block movement of the cylinder 13 toward the rod end 13a, and spring bearings 16 which engaged the end of the coil spring 14 directed toward the head end 13b of the cylinder 13 at the same position as that at which the piston 12 is located when the piston rod 11 is disposed fully within the cylinder 13. In accordance with this embodiment, the stoppers 15 and spring bearings 16 are provided as common members upon the base 2 such that each side inner surface 13' of the cylinder 13 and each flat surface 12' of the piston 12 are in sliding contact with each other and serve as guides for guiding the cylinder 13.

Figure 2:
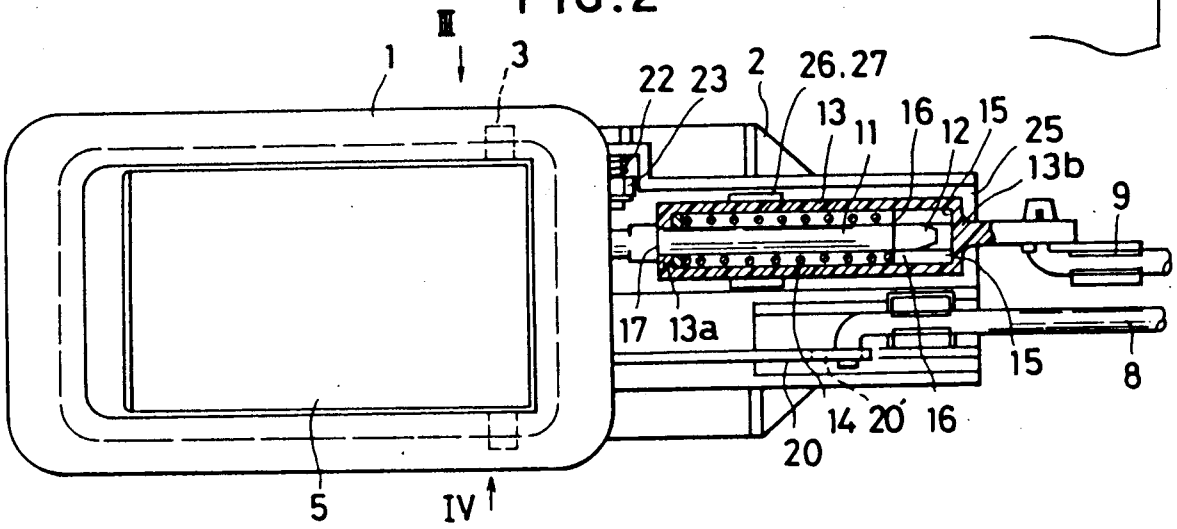
FIG. 2 is an enlarged-scale front view, partly in cross-section; showing the apparatus shown in FIG. 1.
Figure 7:
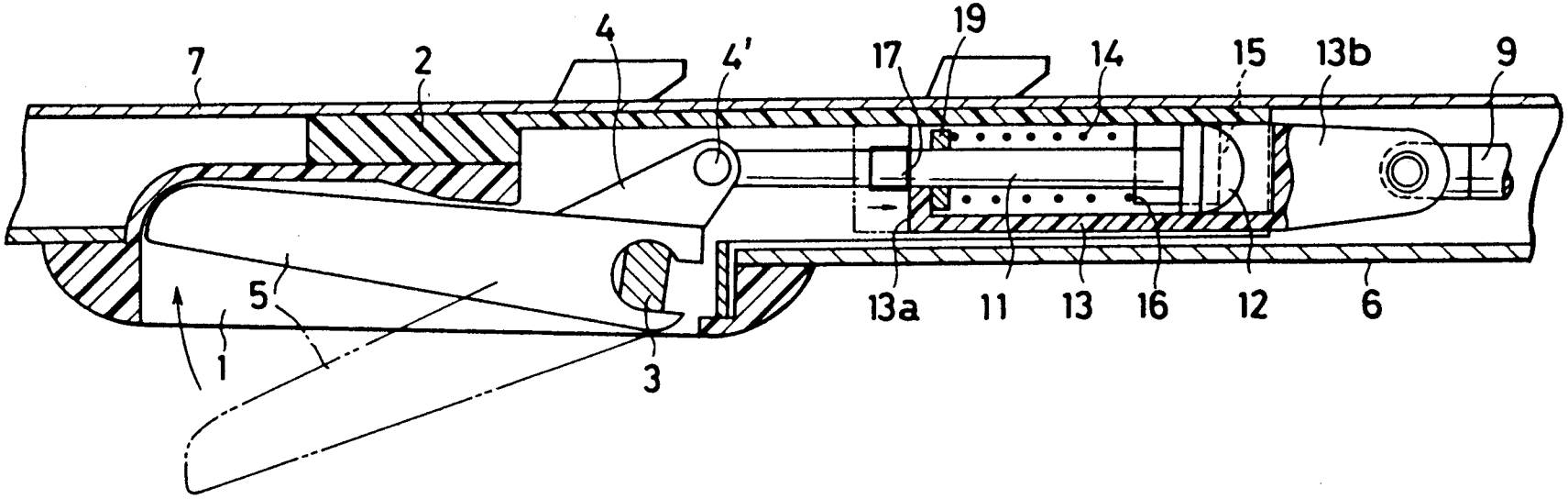
FIG. 7 is an explanatory view showing the state wherein the piston rod of the apparatus of FIG. 1 is pushing the cylinder so as to cause the coil spring to be compressed by means of the rod end of the cylinder.

The piston rod 11 is provided with a laterally or radially outwardly projecting contact portion 17 which abuts upon the rod end 13a of the cylinder 13 from the outer side thereof when the rod 11 is fully disposed within the cylinder 13 as best seen in FIGS. 2 and 7. The lateral dimension of the contact portion 17 is substantially the same as the inner diameter of the coil spring 14.

The piston rod 11 and cylinder 13 are made of plastic materials. In order for the first half of the piston rod 11 including the piston 12 to be accommodated within the cylinder 13, the wall of the rod end 13a of the cylinder 13 is provided with a substantially U-shaped aperture 18, and the piston is located within an axial or central portion of the cylinder 13 with its piston rod portion extending from the contact portion 17 into the cylinder 13 disposed within the aperture 18. A C-shaped collar 19 may be disposed upon a portion of the piston rod 11 located within the cylinder 13 so that it is interposed between the end of the coil spring 14 directed toward the rod end 13a of the cylinder 13 and the rod end 13a of the cylinder 13.

Figure 3:
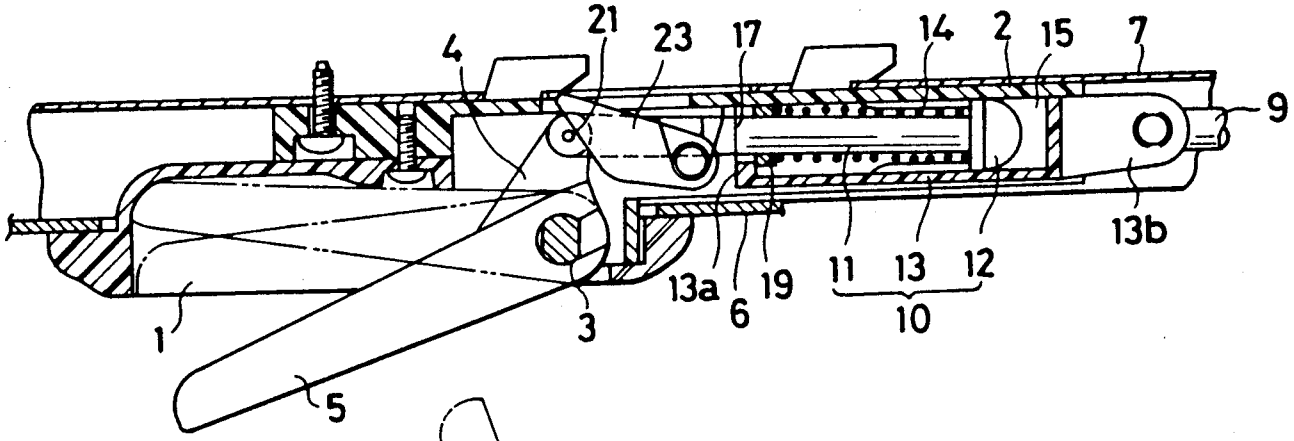
FIG. 3 is a plan view showing the apparatus of FIG. 2 taken in the direction of arrow III.

In this embodiment, with the lever handle 5 disposed at a position slightly outwardly of the frame 1 (that is; at a neutral position), the piston rod 11 coupled to the crank arm 4 is fully projected into the cylinder 13, the contact portion 17 of the rod 11 is in contact with the rod end 13a of the cylinder 13, the inner surface of the head end 13b of cylinder 13, with the rod end 13a urged against the contact portion 17 by means of the coil spring 14, is in contact with the stopper 15 of the base 2, the spring bearing 16 of the base 2 is adapted to receive the end of the coil spring 14 facing the head end 13b of the cylinder 13, and the lever handle 5 is biased toward the neutral position by means of the coil spring 14 (FIG. 3). The unlocking linkage 8 is coupled to the crank arm 4 of the lever handle 5 as seen FIG. 4. With the lever handle 5 disposed at the neutral position slightly outwardly of the frame 1, the unlocking linkage 8 maintains the lock in a released state so as to permit opening and closing of the door. When the lever handle 5 is pivoted away from the frame 1, the unlocking linkage 8 releases the lock, thus permitting the door to be opened by merely pushing upon it from the inside of the vehicle.

Thus, when the lever handle 5, disposed at the neutral position, is pulled so as to release the door lock by means of the linkage 8 (FIG. 6), the piston rod 11 is moved in the direction of being withdrawn from the cylinder 13 while the movement of the cylinder 13 toward the rod end 13a is prevented by means of the stoppers 15. The piston 12 thus compresses the coil spring 14 within the cylinder 13 with respect to the rod end 13a of the cylinder so as to build up a restoring force within the coil spring 14. For this reason, when the lever handle 5 is released after opening the door, it is restored to the initial neutral position by means of the restoring force of the coil spring 14. At this time, the unlocking linkage 8 releases the lock so as to permit opening and closing of the door.

When the lever handle 5 is pivoted in the opposite direction from the neutral position, that is, into the frame 1, the contact portion 17 of the piston rod 11 pushes the rod end 13a of the cylinder 13 (FIG. 7), causing movement of the piston rod 11 and cylinder 13 toward the head end 13b. Since at this time the end of the coil spring 14 directed toward the head end 13b of the cylinder 13 is in contact with the spring bearings 16, the rod end 13a of the cylinder 13 compresses the coil spring 14 with respect to the spring bearings 16 so as to build up a restoring force within the spring. A link 20, as best seen in FIG. 4, coupling the unlocking linkage 8 and crank arm 4 of the lever handle 5 to each other has a slot 20', so that movement of the lever handle 5 into or toward, the frame 1 is not transmitted to the unlocking linkage 8.

As will be described later, the lever handle 5, when pushed into the frame 1, may be locked against the restoring force stored within the coil spring 14 so that it is accommodated within the frame 1 when it is moved from its neutral position at which it extends slightly into the car passenger compartment. Furthermore, the locking linkage 9 is coupled to the head end 13b of the cylinder 13 as best seen in FIG. 3, so that it can lock the lock door lock mechanism so as to prevent opening and closing of the door. Of course, by releasing the lock the lever handle 5 is returned to the neutral position by means of the restoring force of the coil spring 14 so that it can readily operated.

Figure 4:
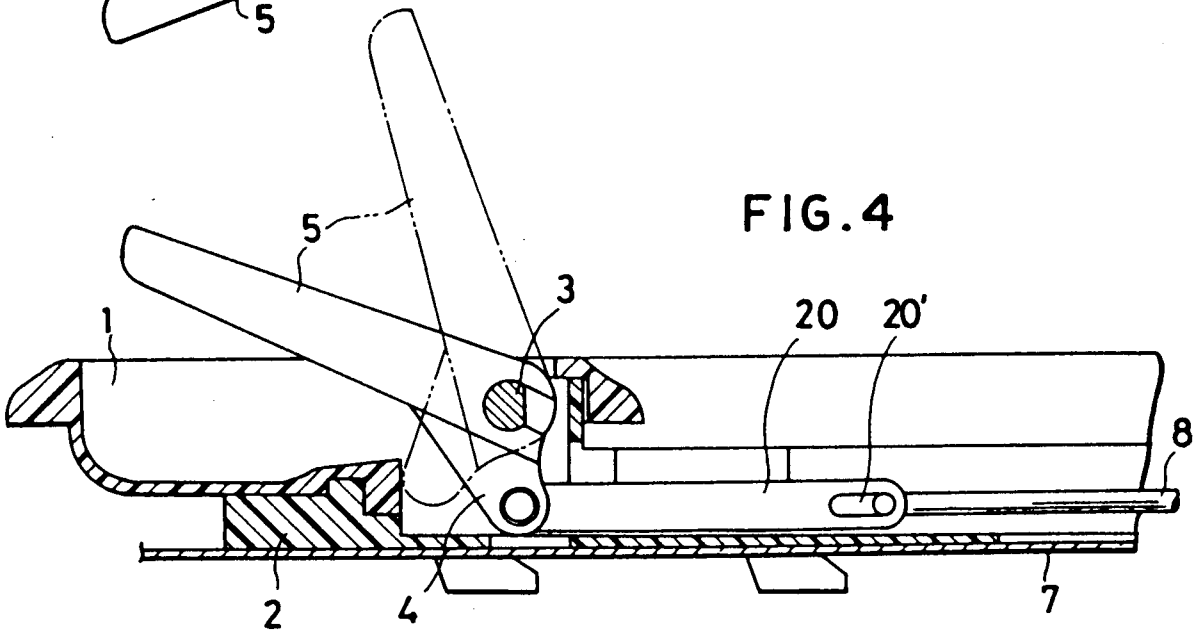
FIG. 4 is a plan view showing the apparatus of FIG. 2 taken in the direction of arrow IV.
Figure 6:
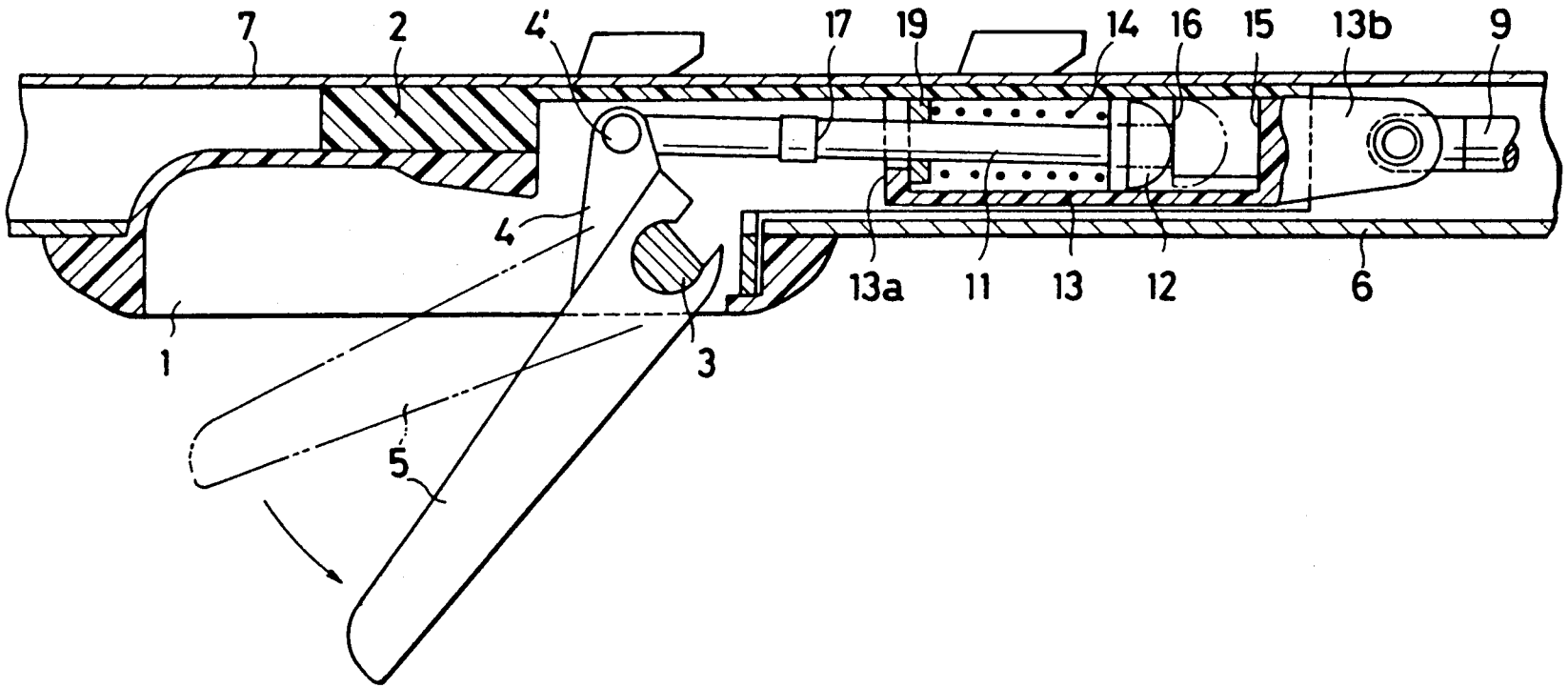
FIG. 6 is an explanatory view showing the state wherein the coil spring is being compressed by means of the piston of the assembly of the apparatus of FIG. 1.
Figure 8:
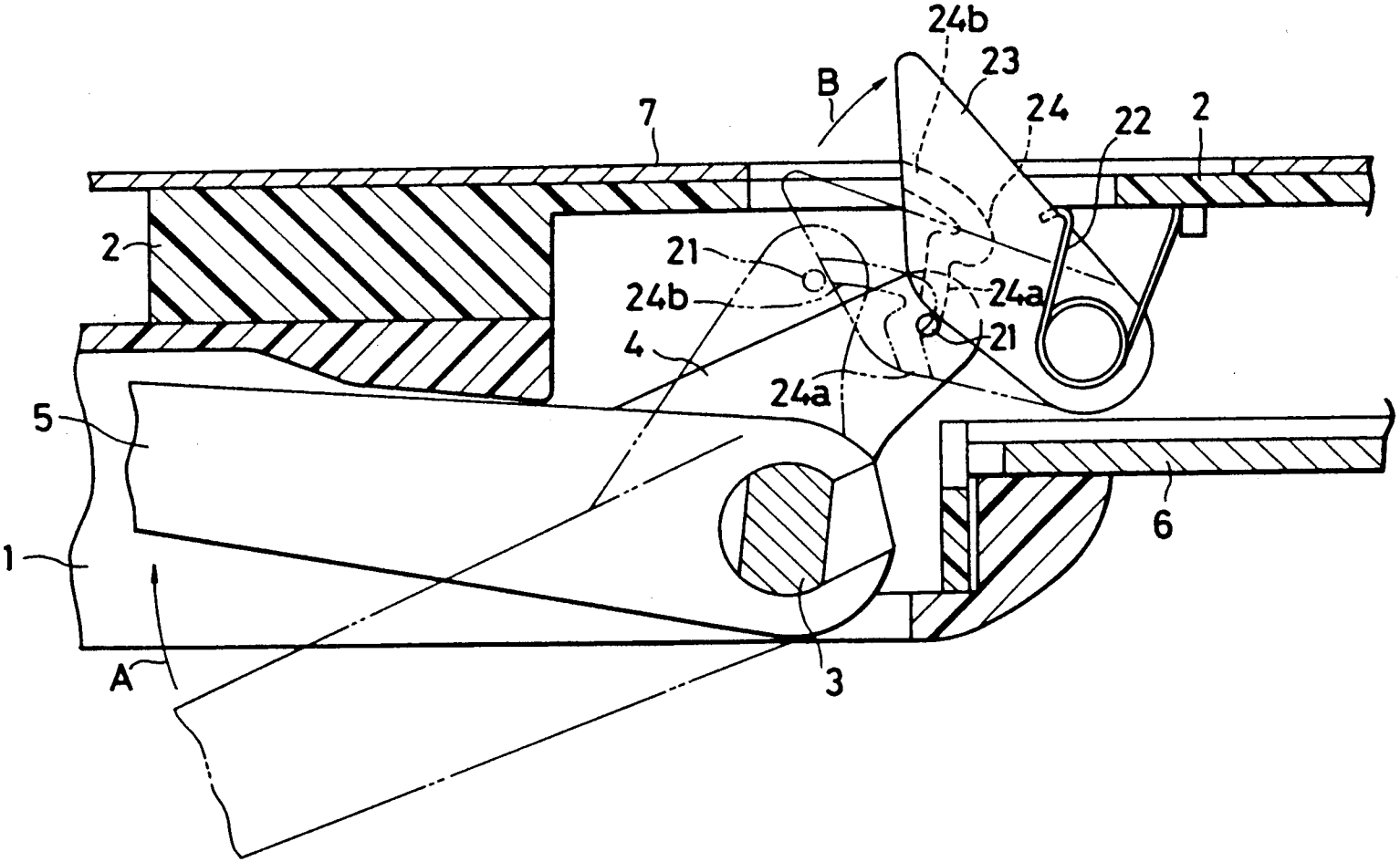
FIG. 8 is an explanatory view showing the positional relationship defined between the crank arm projection and the heart-shaped cam groove of the cam lever when the lever handle of the apparatus shown in FIG. 1 is pushed from the neutral position into the box-like frame.
Figure 9:
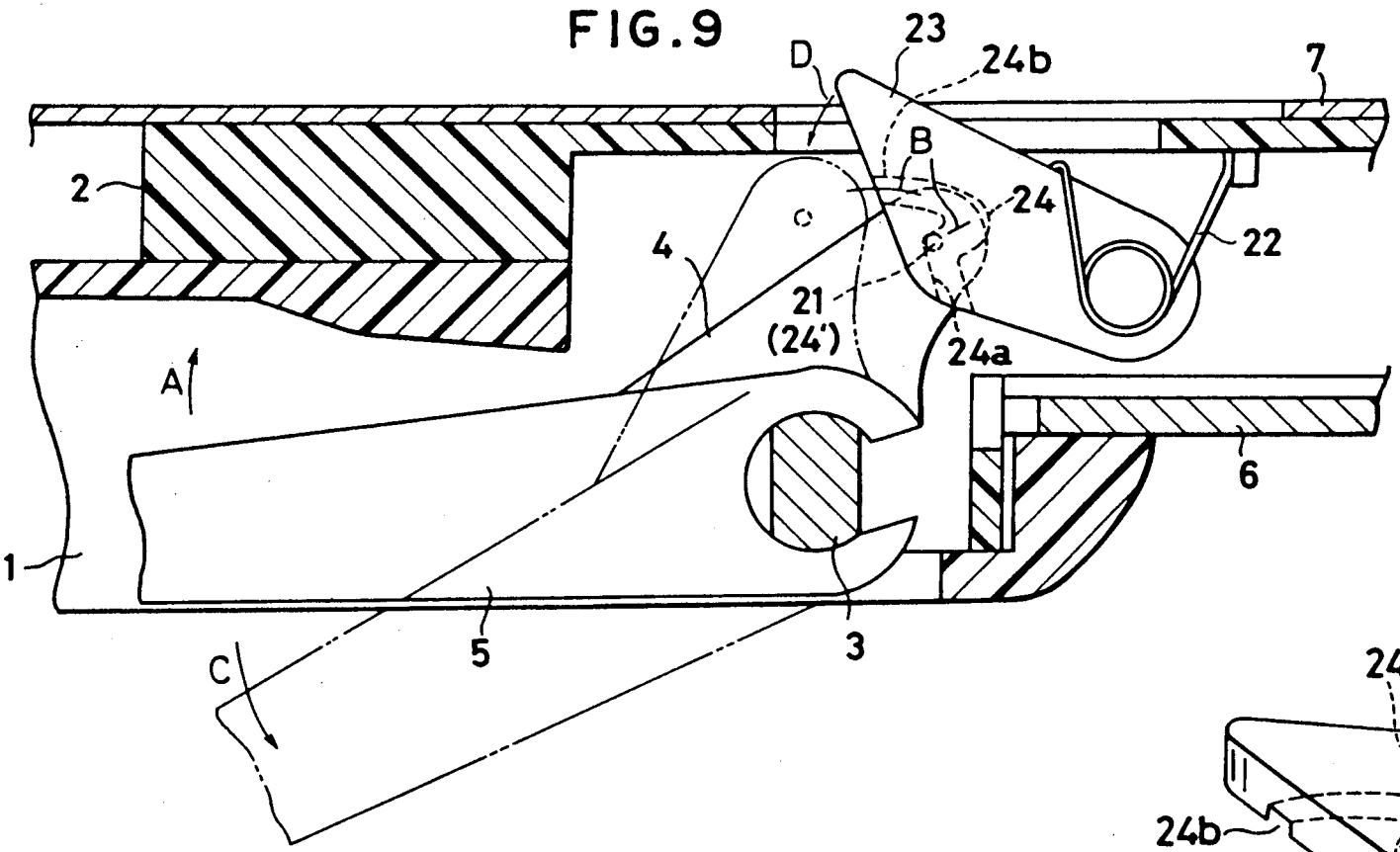
FIG. 9 is an explanatory view showing the relationship defined between the projection and the heart-shaped cam groove when the lever handle accommodated within the box-like frame is moved so as to be returned to the neutral position.
Figure 10:
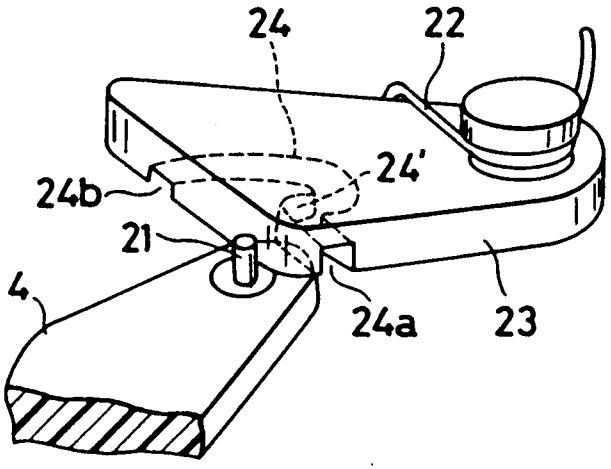
FIG. 10 is a perspective view showing the projection of the crank arm and the heart-shaped groove of the cam lever.

As can be appreciated from drawing FIGS. 4 and 6, the crank arm 4 is coupled to both the link 20 of the unlocking linkage 8 and the piston rod 11 of the locking linkage 9 by means of a pin 4' which is also provided with a coaxial projection 21 as seen in FIGS. 8 and 10. A cam lever 23 biased by means of a spring 22 is pivoted upon the base 2 such that its side surface is disposed in frictional contact with the projections 21 (as shown by the dashed line in FIG. 8). The cam lever 23 has a heart-shaped cam groove 24 which is adapted to be traced by means of the projection 21 when the lever handle 5 is pushed into the frame 1 from the neutral position. The side surface of the cam lever 23 disposed in frictional contact with the projection 21 has an inlet 24a and an outlet 24b of the heart-shaped cam groove 24 (FIGS. 8 to 10).

Thus, when the cylinder 13 is moved as a result of engagement of the rod end 13a of the cylinder 13 by means of the contact portion 17 of the piston rod 11, the lever handle 5 is pushed inwardly with respect to the frame 1 until it strikes the bottom of the frame 1 with the coil spring 14 compressed by means of the rod end 13a of the cylinder 13 with respect to the spring bearings 16 of the base 2 (as shown by arrow A in FIG. 8). At this time, the projection 21 engages the cam lever 23 and pivot the same (as shown by arrow B in FIG. 8), and when it reaches the inlet 24a after by-passing the outlet 24b of the heart-shaped cam groove due to the fact that the pin projection 21 cannot enter outlet 24b as a result of the difference in height dimensions as seen in FIG. 10, (as shown by solid lines in FIG. 8), it enters the cam groove 24 so as to trace the same. The cam lever 23 is thus moved by means of the projection 21 tracing the groove 24. The projection 21 enters the inlet 24a after by-passing the outlet 24*b* of the cam groove 24 because the depth of the outlet 24*b* is smaller than the height of the projection 21 as shown in FIG. 10. Thus, when the projection 21 exits from the outlet 24*b* after tracing the cam groove 24, the cam lever 23 is moved slightly upwardly by means of the projection 21 and swings upwardly. The spring 22 serves to return the slightly elevated cam lever 23 to a horizontal state in addition to causing frictional contact of the projection 21 with the side surface of the cam lever 23. The operation of the heart-shaped cam groove is described in detain in U.S. Pat. No. 4,660,871.

When the lever handle 5, brought into engagement with the bottom of the frame 1 so that it can no longer be pushed inwardly, is then released, it is slightly pivoted in the opposite direction by means of the restoring force stored within the coil spring 14 (FIG. 9). When the surface of the lever handle 5 becomes substantially flush with the open side of the frame 1, the projection 21 having traced substantially one half of the heart-shaped cam groove 24 is locked within a locking section 24' of the cam groove 24, and thus the lever handle 5 is held substantially flush with the open side of the frame 1.

Thus, the lever handle 5 does not project into the car passenger compartment and hinder the driver.

When locking or releasing the door lock by means of operating the lever handle 5, the lever handle 5 is pushed one time inwardly toward the bottom of the frame 1 (as shown by means of arrow A within FIG. 9). When releasing the door lock, the projection 21 locked in the locking section 24' escapes from the section 24', and after tracing the remaining portion of the heart-shaped cam groove 24 it exits from the groove 24 of the cam lever 24 (as shown by arrow B in FIG. 9). In the case of this embodiment, the lever handle 5 is restored to the neutral position which is defined slightly outwardly of the frame 1 (as shown by arrow C in FIG. 9). It is thus projected slightly outwardly from the state accommodated within the frame 1, thereby facilitating the releasing of the door lock. The cam lever 23 is returned by means of the biasing force of the spring 22 to the initial state with its side surface disposed in frictional contact with the projection 21 (as shown by arrow D in FIG. 9).

As was noted earlier, the locking linkage 9 is coupled to the head end 13*b* of the cylinder 13. Thus, by pushing the lever handle 5 from the neutral position until it strikes the bottom of the frame 1 and moving the cylinder 13 by pushing the rod end 13*a* of the cylinder 13 by means of the contact portion 17 of the piston rod 11, the locking linkage 9 coupled to the head end 13*b* of the cylinder 13 locks the door lock so that the door can be neither opened nor closed. At the same time, the lever handle 5 is maintained in its stored state with its surface flush with the open side of the frame 1. To release and liberate the door lock, the lever handle 5 is inwardly, accordingly caused to be returned to the neutral position by means of the restoring force of the coil spring 14, and then further outwardly.

While an embodiment of the invention has been described with reference to the drawings, the frame 1 and base 2 may be made of plastic materials, and the base 2 may be provided with a groove-shaped guide 25 for slidably guiding the piston-cylinder assembly 10 upon the base 2. In this case, the cylinder is provided upon the opposite sides thereof with projections 26 while the guide section of the base 2 is provided with overlapping guides 27 for engaging the projections 26 from above (see FIG. 5). However, this structure is by no means limitative.

As has been described in the foregoing, with the apparatus for operating a linkage by means of the pivotal lever system as disclosed, the linkage can be operated by pivoting the lever handle in one direction or the other from the neutral position. Thus, in the case where a linkage can assume three different states as in the case of a door lock of a car, the state of locking a door so as to prevent opening and closing of the door, the state of unlocking the door so as to permit opening and closing of the door, and the state of opening the door can be selectively determined by means of a single lever. Besides, since the lever handle is maintained in a state biased at the neutral position by means of the coil spring, the structure is very simple, the assembly is easy, and the apparatus is less subject to malfunction.

By means of the apparatus for opening a car door with a pivotal lever according to the invention both the unlocking linkage for releasing the door lock in the locked state and the locking linkage for locking the lock in the released state can be operated by means of a lever handle. Thus, according to the invention, compared with the prior art arrangement where a locking linkage-operating apparatus and a door are provided separately, the number of components used can be reduced and the productivity can be improved. Furthermore, when the lock is locked, the lever handle is accommodated within the frame and does not interfere with the driver or passenger. Still further, when the accommodated lever handle is pushed inwardly, it is subsequently projected slightly outwardly from the frame, thus facilitating the release of the lock.

Obviously, many variations and modifications of the present invention can be made in the light of the above teachings. It is therefore to be understood that within the scope of the appended claims, the present invention may be practiced otherwise than as specifically described herein.

What is claimed is:

1. An apparatus for operating a linkage with a pivotal lever having a crank arm provided on a lever handle pivoted on a pivot and coupled to one end of the linkage, comprising:

a piston-cylinder assembly including a cylinder having a rod end and a head end, a piston having a piston rod coupled to the crank arm and being accommodated in said cylinder, and a coil spring interposed between said piston and said rod end of said cylinder;

a support for supporting the lever handle and said piston-cylinder assembly;

stopper means extending into said cylinder to engage an inner side of said head end of said cylinder, prevent movement of said cylinder toward said rod end but permit movement of said cylinder toward said head end;

a contact portion provided on said piston rod for abutting an outer side of said rod end of said cylinder when said piston rod is fully projected into said cylinder; and spring bearing means for receiving an end of said coil spring directed toward said head of said cylinder at the same position as that of said piston rod when said piston rod is fully projected into said cylinder.

2. An apparatus for opening a door having a box-like frame which is fixed to a surface of the door and on which a lever handle having a crank arm is pivotally mounted with a pivotal lever having an unlocking linkage coupled to the crank arm for releasing a door lock, comprising:

a piston-cylinder assembly including a cylinder having a rod end and a head end, a piston having a piston rod coupled to the crank arm and being accommodated in said cylinder, and a coil spring interposed between said piston and said rod end of said cylinder;

a support coupled to said box-like frame for supporting said piston-cylinder assembly;

stopper means extending into said cylinder to engage an inner side of said head end of said cylinder, prevent movement of said cylinder toward said rod end but permit movement of said cylinder toward said head end;

a contact portion provided on said piston rod for abutting an outer side of said rod end of said cylinder when said piston rod is fully projected into said cylinder;

spring bearing means for receiving an end of said coil spring directed toward said head end of said cylinder at the same position as that of said piston rod when said piston rod is fully projected into said cylinder;

a locking linkage coupled to said head end of said cylinder for locking the door lock;

a projection integrally formed on the crank arm; and a cam lever pivotally mounted on said support and biased so as to be in frictional contact with said projection, said cam lever having a heart cam groove traced by said projection when the lever handle is operated to be accommodated in said box-like frame, said heart cam groove serving to lock the lever handle in a state of being accommodated in said box-like frame.

3. Apparatus for locking and unlocking a door lock of a door, and for opening said door, comprising:

a lever handle pivotably mounted upon a door panel of said door;

unlocking linkage means connected at one end thereof to said pivotably mounted lever handle, and connected at an opposite end thereof to said door lock for unlocking said door lock when said pivotably mounted lever handle is pivotably moved relative to said door panel of said door in a first direction and to a first position;

locking linkage means connected at one end thereof to said pivotably mounted lever handle, and connected at an opposite end thereof to said door lock of said door for locking said door lock when said pivotably mounted lever handle is pivotably moved relative to said door panel of said door in a second direction opposite to said first direction and to a second position;

means for preventing actuation of said locking linkage means when said pivotably mounted lever handle is pivotably moved relative to said door panel of said door in said first direction and to said first position so as to achieve unlocking of said door lock by said unlocking linkage means; and means for preventing actuation of said unlocking linkage means when said pivotably mounted lever handle is pivotably moved relative to said door panel of said door in said second direction and to said second position so as to achieve locking of said door lock by said locking linkage means.

4. Apparatus as set forth in claim 3, further comprising:

means pivotably mounting said lever handle upon said door panel, and said unlocking linkage means connected between said lever handle and said door lock, for unlatching said door lock when said lever handle is moved in said first direction toward a third position disposed beyond said first position.

5. Apparatus as set forth in claim 3, wherein said means for preventing actuation of said locking linkage means, comprises:

a cylinder slidably mounted upon said door panel and fixedly connected at one end thereof to said locking linkage means;

a piston movably disposed within said cylinder and pivotably connected at a free end thereof disposed outside of said cylinder to said lever handle; and stopper means mounted upon said door panel and fixedly disposed inside of said cylinder for engaging said cylinder as said piston is moved within said cylinder in response to pivotable movement of said lever handle in said first direction toward said first position.

6. Apparatus as set forth in claim 5, further comprising:

projection means disposed upon said piston at a position exterior to said cylinder for engaging said cylinder and moving said cylinder in a direction away from said stopper means in response to said pivotable movement of said lever handle in said second direction and to said second position so as to actuate said locking linkage means.

7. Apparatus as set forth in claim 3, wherein said means for preventing actuation of said unlocking linkage means, comprises:

lock-motion linkage means interposed between and interconnecting said unlocking linkage means and said lever handle.

8. Apparatus as set forth in claim 7, wherein said lost-motion linkage means comprises:

a linkage member; and slot means defined within one end of said linkage member for slidably housing a connecting end portion of said unlocking linkage means, whereby when said connecting end portion of said unlocking linkage means is disposed within one end of said slot means of said linkage member, translational movement is transmitted to said unlocking linkage means from said lever handle through said linkage member so as to achieve said unlocking of said door lock as said lever handle is moved in said first direction toward said first position, whereas when said connecting end portion of said unlocking linkage means is disposed within said one end of said slot means of said linkage member, translational movement is not transmitted to said unlocking linkage means from said lever handle through said linkage member so as to prevent actuation of said unlocking linkage means as a result of the translational movement of said linkage member relative to said connecting end portion of said unlocking linkage means as permitted by said slot means.

9. Apparatus as set forth in claim 3, further comprising:

means for locking said lever handle at said second position corresponding to said locking linkage means locking said door lock.

10. Apparatus as set forth in claim 9, wherein said locking means comprises:

a locking pin fixedly mounted upon said lever handle; and cam means, having a cam groove defined therein, for engaging said locking pin of said lever handle and for retaining said locking pin of said lever handle within a locking section of said cam groove.

* * * * *